US006513872B2

(12) United States Patent
Bar

(10) Patent No.: US 6,513,872 B2
(45) Date of Patent: Feb. 4, 2003

(54) MULTIPART UPHOLSTERED FURNITURE

(75) Inventor: Kurt Bar, Klingnau (CH)

(73) Assignee: De Sede AG, Klingnau (CH)

( * ) Notice: Subject to any disclaimer, the term of this patent is extended or adjusted under 35 U.S.C. 154(b) by 0 days.

(21) Appl. No.: 09/860,650

(22) Filed: May 18, 2001

(65) Prior Publication Data

US 2002/0171273 A1 Nov. 21, 2002

(51) Int. Cl.[7] ..... A47C 15/00

(52) U.S. Cl. ..... 297/232; 297/344.22; 297/142; 248/425

(58) Field of Search ..... 297/344.21, 344.22, 297/248, 115, 117, 232, 323

(56) References Cited

U.S. PATENT DOCUMENTS 3,486,790 A * 12/1969 Barecki et al. ..... 297/142
4,822,099 A * 4/1989 Negi et al. ..... 248/425
4,925,227 A * 5/1990 Bateman ..... 105/345
6,302,483 B1 * 10/2001 Ricaud et al. ..... 297/344.22

* cited by examiner

*Primary Examiner*—Anthony D. Barfield
*Assistant Examiner*—Erika Garrett
(74) *Attorney, Agent, or Firm*—Ladas & Parry

(57) ABSTRACT

A seat cushion part (3) is located on an upper plate (16). This upper plate (16) is supported on a lower plate (17) of the bottom frame of the furniture. A slot (25) is formed in the lower plate (17) in which slot (25) the upper plate (16) is guided for a longitudinal movement and a rotational movement. A control arm (34) is pivotally mounted at one end to the lower plate (17) at a location which is aligned with the slot. At its opposite end the control arm (34) is pivotally mounted to the upper plate (16) at a location to the side of the slot (25). When the upper plate (16) is rotated together with the seat cushion part (3) the front corner area (14) of this seat cushion part (3) which is located aside of an adjoining seat cushion part (2) moves along a straight line (15) which coincides with the side edge section (9) of this seat cushion part (2).

8 Claims, 3 Drawing Sheets

MULTIPART UPHOLSTERED FURNITURE

BACKGROUND OF THE INVENTION

1. Field of the Invention

The present invention relates to a upholstered furniture, having a bottom frame, at least two adjoining seat cushion parts and back cushion parts, each back cushion part allocated to one of the adjoining seat cushion parts, and having back cushion parts, each one allocated to one seat cushion part, of which seat cushion parts at least one is displaceable.

2. Description of the Related Art

A user of such an upholstered furniture, also called couch, sits on the seat in such a position, that his lower legs extend more or less vertically and his feet rest on the floor or possibly on a foot support. After a certain time, however, such a seating position is felt to be uncomfortable.

A more comfortable and relaxed position is a lying position in which the legs extend and rest more or less horizontally, to which end the feet rest often on a small table or a stool placed in front of the couch. This necessitates, however, that in addition to the couch a further piece of furniture must be present.

Adjustable upholstered furniture is known in the art, indeed, but such furniture can not be used as a couch having several seats.

BRIEF SUMMARY OF THE INVENTION

Thus, it is a general object of the present invention to provide a multipart upholstered furniture which can be changed from a seat configuration into a lying configuration with a minimal expenditure of work and a minimal demand on space.

A further object of the invention is to provide a multipart upholstered furniture which has at least one guiding apparatus adapted to guide a respective seat cushion part relative to the bottom frame so that a respective seat cushion part is rotatable relative to the bottom frame in a horizontal plane and is simultaneously rectilinearly displaceable relative to the bottom frame, while a respective adjoining seat cushion part and all back cushion parts remain at rest.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF THE INVENTION

Figure 1:
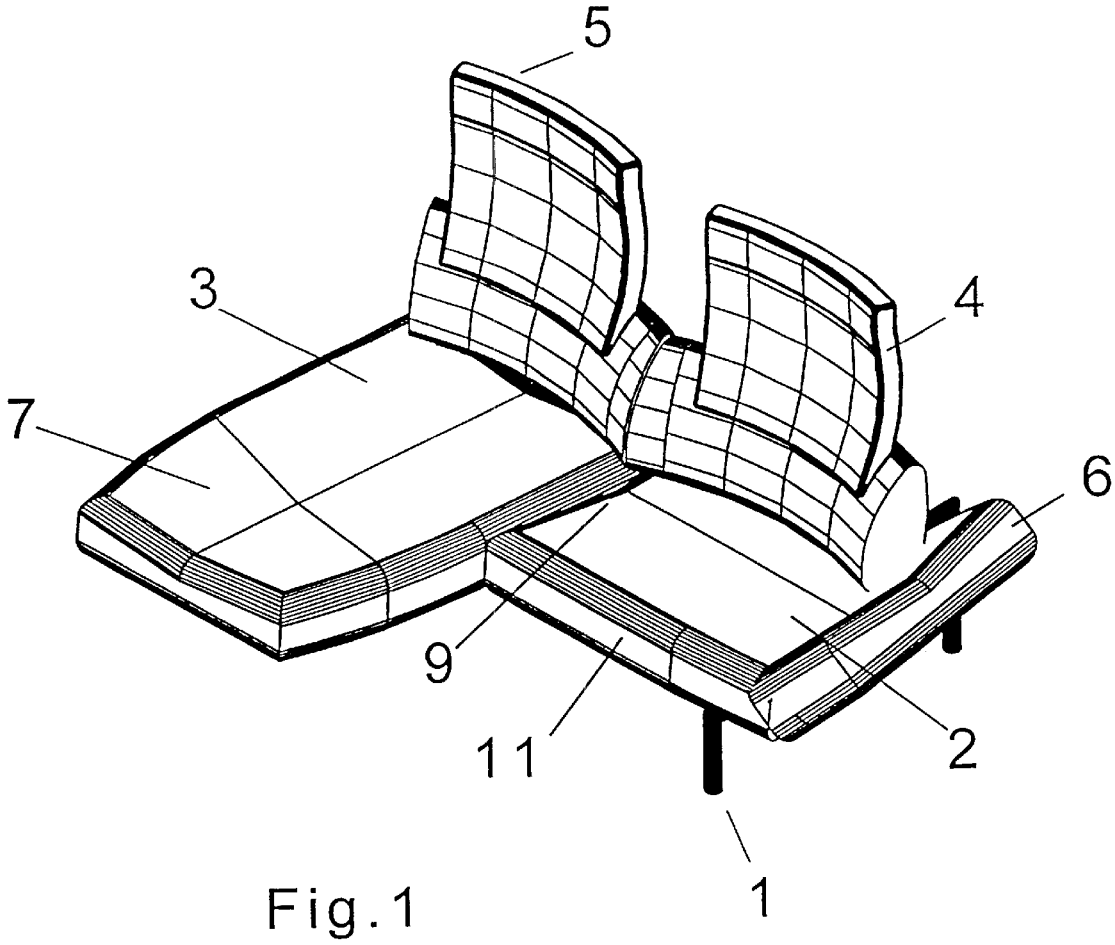
FIG. 1 illustrates a two-piece upholstered furniture, of which one piece is in a seat configuration and the other piece is in a lying configuration.

FIG. 1 illustrates a multipart upholstered furniture which is designed as a two-piece couch. A first seat cushion part 2 and a second seat cushion part 3 adjoining the first seat cushion part 2 are arranged on a bottom frame 1 of which merely the supporting legs are visible in the drawing figure. A first back cushion part 4 is allocated to the first seat cushion 2. A second back cushion part 5 is allocated to the second seat cushion part 3. The two back cushion parts 4, 5 are arranged stationary relative to the bottom frame 1.

In FIG. 1, the first seat cushion part 2 is illustrated in the seat configuration, in a first end position, and a pivotable arm-rest 6 is pivotably mounted to the seat cushion part 2 which arm-rest is in a upwards pivoted position when in the seat configuration.

This first seat cushion part 2 can now be rotated in a horizontal plane about 90° into a lying configuration in which it is located in a second end position. Relative to the illustration of FIG. 1 the rotating movement of the first seat cushion part proceeds in a clock-wise direction.

The second seat cushion part is illustrated in a position in which it is rotated into the lying configuration, which is defined herein as the second end position. To this end, it has been rotated from the seat configuration clockwise by 90° into the illustrated position, whereby its previous arm-rest 7 has been pivoted or folded, resp. downwards so that it now serves as a foot rest. Accordingly, the second seat cushion part 3 can be rotated from the illustrated position back and its arm-rest 7 can be pivoted upwards so that a two-seat couch is formed on which a person can sit down.

As can be seen in FIG. 1, it is not possible to simply rotate the two seat cushion parts 2, 3 around a stationary axis of rotation because they are located closely side-by-side. In order to execute the rotational movement, the moveable seat cushion parts 2, 3 are each mounted through a guiding apparatus onto the bottom frame, by means of which guiding apparatus the rotational movement proceeding in a horizontal plane is positively transformed into a rectilinear displacement movement superimposed over the rotational movement.

For an initial explanation of these movements attention is drawn to FIGS. 3A–3G.

Figures 3A, 3B, 3C, 3D, 3E, 3F, 3G:
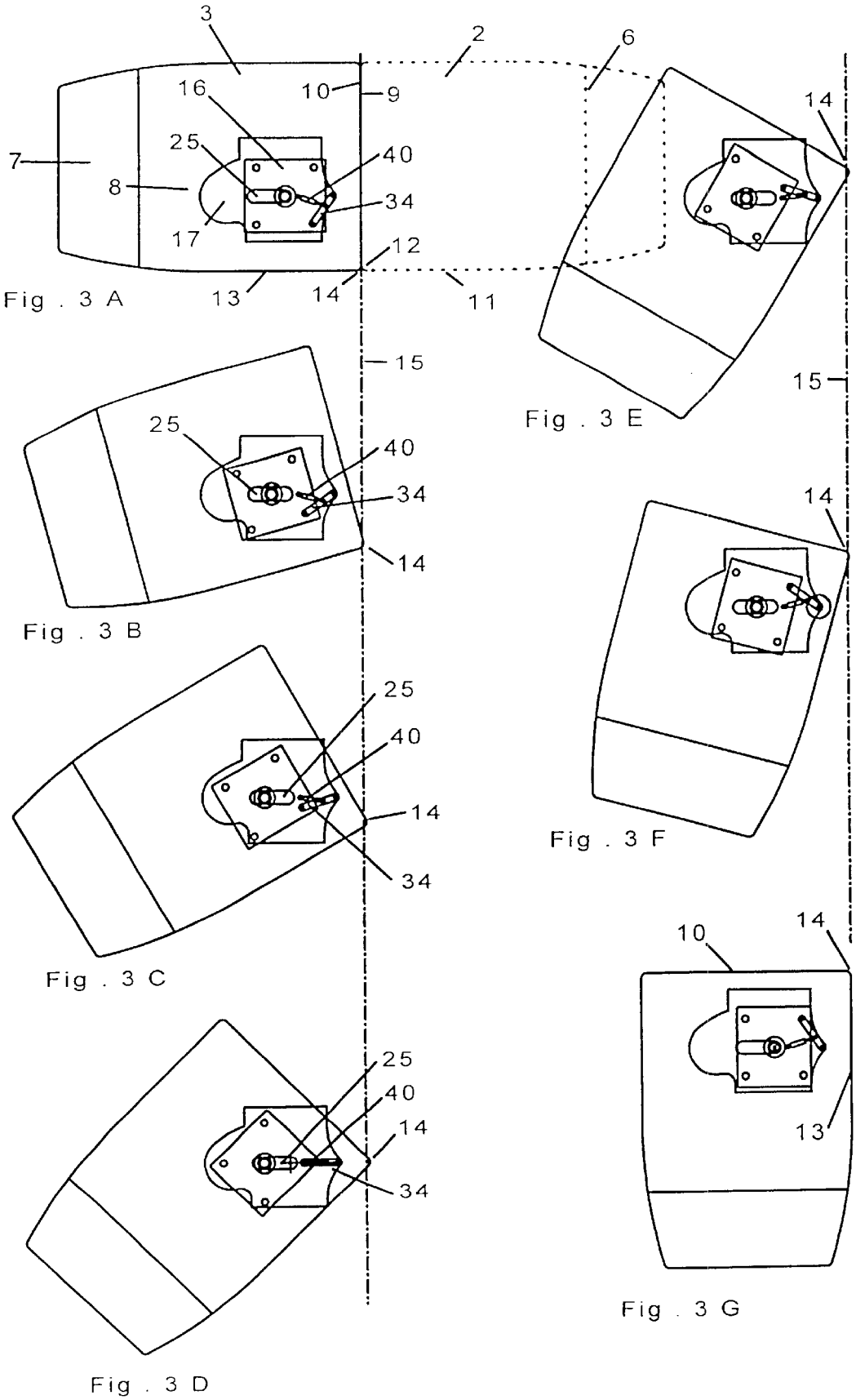
FIGS. 3A–3G illustrate in a somewhat schematic view the working operation of the guiding apparatus with a seat cushion mounted thereto.

FIG. 3A illustrates the two seat cushion parts 2, 3 in the seat configuration in accordance with the illustration of the first seat cushion part 2 in FIG. 1. Thus, both are in their first end position. The armrests 6, 7 have already been turned down.

The first seat cushion part 2 is in the first end position, see also FIG. 1, and the second seat cushion part 3 shall now be rotated out of the first end position illustrated in FIG. 3A into the second end position according to FIG. 3G. The first seat cushion part 2 includes a side edge section 9 which contacts and abuts directly the side edge section 10 of the adjoining second seat cushion part 3.

The side edge section 9 of the first seat cushion part 2 is followed in the illustrated seat configuration by a front edge section 11, and the corner area present between these two sections 9, 11 is identified by the reference numeral 12. In the like manner, the side edge section 10 of the second seat cushion part 3 is followed by a front edge section 13, and the corner area present between these two sections 3, 13 is identified by the reference numeral 14.

When the second seat cushion part 3 is rotated e.g. from the position according to FIG. 3A into the position according to FIG. 3B, the second seat cushion part 3 is guided by the guiding apparatus 8 which will be described further below in such a manner, that the corner area 14 moves along a straight line 15 which coincides generally with the side edge section 9 of the stationary first seat cushion part 2, so that during the rotating movement of the second seat cushion part its corner area 14 passes or slides, respectively along the side edge section 9 of the first seat cushion part 2.

After the second seat cushion part 3 has reached the second end position illustrated in FIG. 3G it is in the lying configuration. In this state its (original) front edge section 13 lies against and contacts the side edge section 9 of the not rotated first seat cushion part 2 which is till in the first end position according to FIG. 3A.

Now, if desired, the first seat cushion part 2 can be rotated too, whereby its said corner area 12 is also moved along the straight line 15. When now also the first seat cushion part 2 is located in its second end position, the two (original) front edge sections 11, 13 of the two seat cushion parts 2, 3 contact each other.

It shall be noted that the back cushion parts 4, 5 do not take part in the rotational movements. They are firmly mounted to the bottom frame.

In order to execute the described rotational movements during which the respective corner areas 12, 14 move along a straight line each seat cushion part 2, 3 is guided by a guiding apparatus 8 which will now be described with reference to FIG. 2.

This guiding apparatus 8 includes an upper plate 16 which is connected to a respective seat cushion part 2 or 3, respectively. The guiding apparatus 8 includes, furthermore, a lower plate which is mounted to the bottom frame 1.

Figure 2:
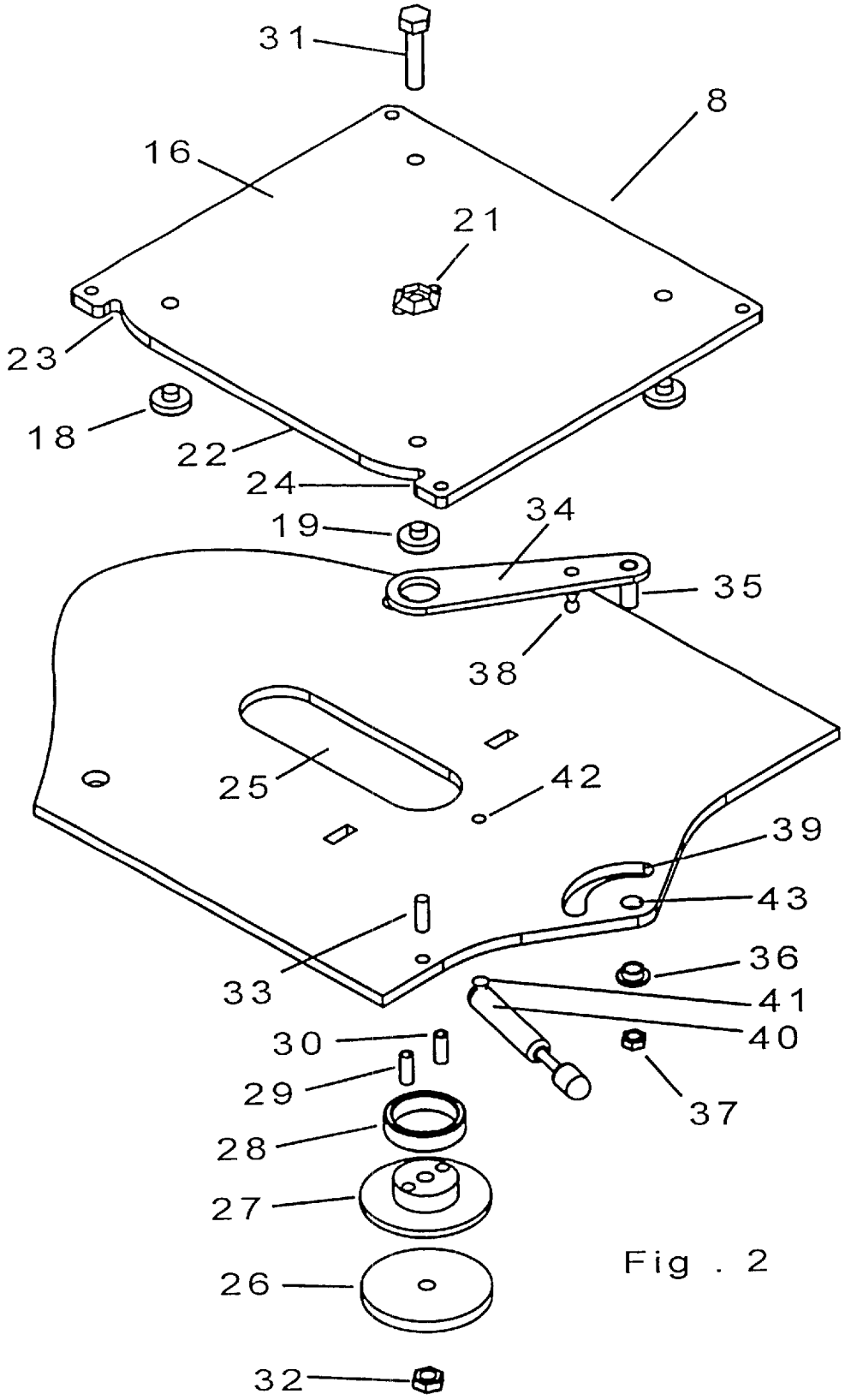
FIG. 2 is an exploded view of a guiding apparatus.

The upper plate 16 has a roughly square outline and is supported on the lower plate 17 by means of four sliding members of which three sliding members 18, 19, 20 are visible in FIG. 2. A through hole 21 is located at the center of the upper plate 16. Furthermore, two recesses 23, 24 are present in one side 22 of the upper plate 16.

The lower plate 17 includes a slot 25. A slider is set into this slot 25. It has at the bottom a disc 26 on which a distance block 27 is located which supports a running member 28 which runs in the slot 25. Furthermore, two clamping pegs 29, 30 are seated in the distance block 27.

For an assembling a threaded bolt 31 is inserted through the through hole 21 of the upper plate 16 which bolt 31 extends through the distance block 27 and the disc 26 and finally the lock nut 32 is screwed onto the threaded bolt.

Thus, the upper plate 16 can move rectilinearly along the slot 25 and at the same time rotate relative to the lower plate 17.

An abutment pin 33 projects from the lower plate 17 which co-operates with the recesses 23 and 24 in the side of the upper plate 16 in order to define the end positions of the rotary movement of the upper plate 16. As can be seen, in the illustrated position of the upper plate 16 the abutment pin 33 is received in the recess 24. At the other end position, the abutment pin 33 is received in the recess 23.

A control arm 34 is pivotally mounted at one end via a pin 35 to the lower plate 17 at a location which is aligned with the longitudinal centerline of the slot 25. This location, a hole 43, is located adjacent a side edge of the lower plate 17, whereby the bearing bushing 36 and the lock nut 37 are illustrated too.

This control arm 34 is pivotally mounted at its opposite end via the sliding member 19 to the upper plate 16, thus at a location beside the longitudinal centerline of the slot 25.

A ball end pin 38 projects from the control arm 34 downwards, which ball end pin extends through an arcuate opening 39 and is mounted to one end of a gas pressure spring 40. This gas pressure spring 40 is pivotally mounted at its opposite end via a pin 41 which is set into a hole 42 in the lower plate 17 to the lower plate 17. As can be seen, this hole 42 is aligned with the extended longitudinal center line of the slot 25, and the hole 43 for the receipt of the pin 35 of the control arm 34 is also aligned with mentioned longitudinal center line.

The operation of this guiding apparatus is as follows.

If the upper plate 16 (which is mounted to a seat cushion part) is rotated counter clockwise based on the illustration according to FIG. 2, this movement causes a pivoting movement of the control arm 34 which conclusively pushes the plate 16 away along the slot 25. Thus, the rotational movement of the upper plate 16 produces through the control arm positively a rectilinear displacement movement of the plate 16 which is superimposed over said rotational movement. This means, with reference to the FIGS. 3A–3D, that the seat cushion part is displaced away from the described straight line 15, and by a corresponding selection of the dimensions of the individual parts of the control apparatus 8 precisely to such an extent that the corner area 14 of the seat cushion part 3 remains at any rotational position of the seat cushion part on the straight line 15.

During the first phase of the rotational movement of the upper plate 16 the gas pressure spring 40 is biased against its elastic restoring force.

The gas pressure spring 40 is in its maximal tensioned, i.e. compressed state when the upper plate 16 has been rotated by 45°. This position corresponds to a deadcenter position of the rotational movement. Upon a further rotating beyond the 45° position the upper plate 16 with the respective seat cushion part is urged by the gas pressure 10 spring 40 into the other end position and is held in that position. This is quite convenient for the user because the user must rotate the seat cushion part only a little more than 45° because the further rotational movements proceed thereafter at its own.

The effect of the operation of the guiding apparatus is made specifically clear in the FIGS. 3A–3G.

FIG. 3A illustrates an end position, i.e. an initial position of the seat cushion part 3, in the seat configuration. If now the seat cushion part 3 is rotated from the position 3A into the position 3B, it, that is the upper plate 16 is displaced in the slot due to the control-arm 34, so that the corner area 14 remains on the straight line in spite of the rotation. The gas pressure spring 40 is tensioned, i.e. compressed against its elastic restoring force. Upon a continued rotational movement from the position of FIG. 3B to the position 3C the plate 16 is still further advanced in the slot 25, the gas pressure spring 40 is compressed still further.

Thereafter, the position according to FIG. 3D is reached, which is a 45° position. In this position the slot 25, the control arm 24 and the gas pressure spring 40 are aligned with each other. The gas pressure spring is in its maximal stressed state.

Upon a further rotating of the seat cushion part in the direction in accordance with FIG. 3E, the upper plate 16 is now pulled back along the slot 25 by the control arm 34, so that the corner area 14 still moves along the straight line 15. However, no further manual expenditure of force is needed, because the elastic restoring force of the gas pressure spring 40 acts now onto the control arm 34. Accordingly, the seat cushion part 3 moves through the position according to FIG. 3F into the end position according to FIG. 3G and with this the seat cushion part 3 is now in the lying configuration. The recess 23 in the upper plate 16 is therewith pressed by the gas pressure spring against the abutment pin 33 and held in that state, that is the seat cushion part 3 is now arrested in this position.

When the seat cushion part 3 is rotated from the lying configuration according to FIG. 3G back into the seat configuration according to FIG. 3A the same actions of the various members of the guiding apparatus 8 occur as have happened during the previous rotating.

While there is shown and described a present preferred embodiment of the invention, it is to be distinctly understood that the invention is not limited thereto, but may be otherwise variously embodied and practiced within the scope of the following claims.

What is claimed is:

1. A multipart upholstered furniture, having a bottom frame (1), at least two adjoining seat cushion parts (2; 3) and back cushion parts (4; 5) each back cushion part (4; 5) allocated to one of the adjoining seat cushion parts (2; 3), comprising at least one guiding apparatus (8) adapted to guide a respective seat cushion part (2; 3) relative to said bottom frame (1) so that a respective seat cushion part (2; 3) is rotatable relative to said bottom frame (1) in a horizontal plane and is simultaneously rectilinearly displaceable relative to said bottom frame (1), while a respective adjoining seat cushion part (3; 2) and all back cushion parts (4; 5) remain at rest, wherein each guiding apparatus (8) comprises an upper plate (16) mounted firmly to a moveable seat cushion part (2; 3), and a lower plate (17) mounted firmly to said bottom frame (1), said bottom frame (1) having a slot (25) in which said upper plate (16) is guided by means of a slider (27; 28) for a longitudinal displacing movement and supported for a rotational movement, wherein said guiding apparatus (8) comprises a control arm (34) which is pivotally mounted at a first end of a first pivotal point to said upper plate (16) which is at a location remote from said slider (27; 28), and is pivotally mounted at a second end opposite of said first end at a second pivotal point to said lower plate (17).

2. The multipart upholstered furniture of claim 1, wherein each moveably supported seat cushion part (2; 3) is coupled by one guiding apparatus (8) onto said bottom frame (1), which guiding apparatus (8) is designed to convert a rotational movement in a horizontal plane of the respective seat cushion part (2; 3) positively into a simultaneous superimposed rectilinear displacing movement.

3. The multipart upholstered furniture of claim 2, in which said moveable seat cushion parts (2; 3) are supported for a rotation between two end positions through an angle at 90° and have in relation to a first end position a side edge section (9; 10) adjoined by a front edge section (11; 13) extending laterally relative to the side edge section (9; 10), said side edge section (9; 10) and said front edge section (11; 13) defining a corner area (12; 14) therebetween, wherein each guiding apparatus (8) is designed to guide the respective corner area (12; 14) during a movement of the respective seat cushion part (2; 3) along a straight line (15).

4. The multipart upholstered furniture of claim 3 and having two adjoining seat cushion parts (2; 3), wherein said seat cushion parts (2; 3) contact each other in a first end position along their side edge sections (9; 10), and wherein a seat cushion part (3) located in a second end position contacts the side edge section (9) of the seat cushion part (2) located in the first end position along its front edge section (13).

5. The multipart upholstered furniture of claim 4, wherein the two seat cushion parts (2; 3) contact each other in their second end position along their front edge sections (11; 13).

6. The multipart upholstered furniture according to claim 1, comprising further a pressure spring unit (40) which is pivotally mounted at one end to said control arm (34), and is pivotally mounted at a second end opposite of said first end to said lower plate (17), so that said upper plate (16) with a respective seat cushion part (2; 3) mounted thereto is biased into a respective end position and held spring elastically arrested in said end position.

7. The multipart upholstered furniture according to claim 6, wherein said second pivotal point is located at an edge area of said lower plate at a location which is aligned with the center line of said slot (25), and wherein said pressure spring unit (40) is pivotally mounted at one end to said control arm (34) and at its end opposite of said one end at a further location to said lower plate (17) which is aligned with the center line of said slot (25).

8. The multipart upholstered furniture according to claim 7, wherein said upper plate (16) has an approximately square shaped outline and includes at its four corner areas sliding elements (18; 19; 20) through which it is supported on said lower plate (17), further wherein two recesses (23; 24) are formed in one side (22) of said upper plate (16) and the lower plate (17) includes a projecting abutment pin (33), whereby said two recesses (23; 24) cooperate with said abutment pin (33) to set a respective end position of the movement of said upper plate (16) with the seat cushion part (2; 3).

* * * * *